US005737815A

United States Patent [19]

Le

[11] Patent Number: 5,737,815

[45] Date of Patent: Apr. 14, 1998

[54] METHOD AND APPARATUS FOR CONTROLLING A TAKE-UP POINT WHEN TEXTURIZING A YARN

[75] Inventor: Sanh Le, Conyers, Ga.

[73] Assignee: Fiberco Inc., Wilmington, Del.

[21] Appl. No.: 609,125

[22] Filed: Feb. 29, 1996

[51] Int. Cl.[6] ..... D02G 1/00; D02J 1/00

[52] U.S. Cl. ..... 28/250; 28/220; 28/241

[58] Field of Search ..... 28/250, 220, 241

[56] References Cited

U.S. PATENT DOCUMENTS

| | | | |
|---|---|---|---|
| Re. 31,783 | 1/1985 | Borenstein et al. . | |
| 3,342,975 | 9/1967 | Carr . | |
| 3,842,468 | 10/1974 | Harrison . | |
| 3,902,231 | 9/1975 | McKinney . | |
| 3,961,401 | 6/1976 | Ferrier et al. . | |
| 3,977,058 | 8/1976 | Borenstein et al. . | |
| 4,012,816 | 3/1977 | Hatcher . | |
| 4,134,191 | 1/1979 | Kim et al. . | |
| 4,135,511 | 1/1979 | Nikkel . | |
| 4,171,402 | 10/1979 | Eskridge et al. . | |
| 4,204,301 | 5/1980 | Corron et al. . | |
| 4,295,252 | 10/1981 | Robinson et al. . | |
| 4,316,311 | 2/1982 | Feffer . | |
| 4,320,563 | 3/1982 | D'Agnolo . | |
| 4,369,555 | 1/1983 | Nikkel . | |
| 4,404,718 | 9/1983 | Tajiri et al. | 28/250 |
| 4,608,736 | 9/1986 | Tajiri et al. | 28/220 |
| 4,796,340 | 1/1989 | Gerhards . | |
| 4,896,407 | 1/1990 | Haynes . | |
| 5,036,568 | 8/1991 | Goineau . | |
| 5,088,168 | 2/1992 | Berger et al. . | |
| 5,110,517 | 5/1992 | Lukhard et al. . | |

FOREIGN PATENT DOCUMENTS

| | | | |
|---|---|---|---|
| 29 08 773 | 9/1979 | Germany | 28/250 |

*Primary Examiner*—Andy Falik

*Attorney, Agent, or Firm*—Greenblum & Berstein P.L.C.

[57] ABSTRACT

A method and apparatus for maintaining a yarn take-up point stationary. A first sensor, such as an optical sensor, is positioned proximate a first location of a yarn travel path to output a first signal representative of the position of a yarn at the first location. A second sensor, such as another optical sensor, is positioned proximate a second location of the yarn travel path to output a second signal representative of the yarn at the second location. A controller controls a temperature of a fluid employed to heat the yarn. The controller receives the first signal and the second signal, which are analyzed to produce a heat control signal that is used to control the temperature of the fluid. The heated fluid is used to texturize the yarn, such that the yarn is tensioned and maintained so that a yarn take-up point is substantially stationary.

43 Claims, 5 Drawing Sheets

METHOD AND APPARATUS FOR CONTROLLING A TAKE-UP POINT WHEN TEXTURIZING A YARN

BACKGROUND OF THE INVENTION

1. Field of the Invention

The present invention is directed to a method and apparatus for maintaining a yarn tension and yarn take-up point to achieve a uniform yarn texture in a yarn texturizing process.

2. Discussion of Background and Other Information

In processing thermoplastic yarn, such as polyolefin or polypropylene fibers, it is frequently desirable to produce a yarn of a predetermined bulk and cover. Several methods and apparatus have been developed for texturizing yarn. In one method, a yarn nozzle is provided with a yarn duct which is supplied with hot air and which terminates in an expansion chamber having a larger cross section than the yarn duct. The expansion chamber possesses at least one outlet. The hot air supplied into the yarn duct expands with the yarn in the expansion chamber. Consequently, the multifilament yarn is expanded in the expansion chamber and compressed to a yarn plug. The yarn plug is then advanced by the pressure in the expansion chamber and deposited, after leaving the expansion chamber, on a slowly rotating cooling drum.

In order to produce the texturized yarn with the desired properties, it is important to maintain a predetermined tension on the yarn. Specifically, in a texturizing process utilizing a rotating circular cooling drum, a constant yarn tension must be maintained, usually by keeping the yarn take-up point (plug position) stationary. Traditionally, the plug position has been manually adjusted by adjusting a temperature setpoint in a texturizing jet air that is located upstream, in a heater of a bulking air jet.

Unfortunately, the effectiveness of the modulation (adjustments) of the temperature setpoint is dependent upon a human operator. As yarn production increases and doff time decreases, it becomes increasingly difficult for a human operator to properly adjust the temperature setpoint of the jet air and bring the plug into the desired position.

SUMMARY OF THE INVENTION

Accordingly, an object of the present invention is to provide an automatic plug position control system. The automatic plug position control system controls the positioning of the yarn based upon yarn position feedback information that is used to adjust the jet air temperature.

According to an embodiment of the present invention, the automatic tension control of the yarn take-up point includes at least one position detecting device that detects an end position of the yarn as it exits a cooling drum. The detecting device provides a feedback signal to an associated controller. In response to the feedback signal, the temperature of a bulking jet air is adjusted.

The position detecting device comprises a sensor that may be, for example, a photosensor, an ultrasonic sensor, a light (laser) sensor or an inductance sensor. The controller comprises, for example, a general purpose computer that executes a specially prepared routine. Alternatively, the controller may comprise a specially created programmable logic controller.

According to an object of the present invention, an automatic control system is disclosed for controlling a tension on a yarn. A position of the yarn is sensed after the yarn has been subjected to a heated fluid. In response to the sensed yarn position, a setpoint temperature of said heated fluid is adjusted in order to vary the tension on the yarn. The position of the yarn is detected by at least one sensor, which may comprise an optical sensor.

In the preferred embodiment, two optical sensors are employed. A first sensor is positioned at a first predetermined position along a travel path of the yarn, while a second sensor is positioned at a second predetermined position along the travel path of the yarn.

The temperature of the heated fluid is varied by blending a cold air stream with a hot air stream. Alternatively, the temperature of the heated fluid may be varied by adjusting a setpoint temperature of a heater.

According to an advantage of the present invention, a method is disclosed for controlling a tension on a yarn, comprising the steps of sensing a position of the yarn after the yarn has been subjected to a heated fluid, and varying a temperature of the heated fluid in order to vary the tension of the yarn.

According to another advantage of the present invention, an ejection travel path of the yarn is detected using a sensor, such as an inductance or optical sensor.

According to another advantage of the present invention, two sensors are employed to detect the end position of the yarn. A first sensor is positioned at a first predetermined position along a travel path of the yarn, and a second sensor is positioned at a second predetermined position along the travel path of the yarn.

According to another advantage of the present invention, a cold air stream is blended with a hot air stream in order to maintain a constant tension on the yarn. Alternatively, a setpoint temperature of the heated fluid is varied in order to maintain a constant tension on the yarn.

According to another object of the present invention, a system for controlling a tension on a yarn comprises a sensor that is positioned proximate a predetermined location of a travel path of the yarn to sense an end position of the yarn, and a controller that operates to vary a temperature of a fluid to which the yarn is subjected so as to effect a change in a tension of the yarn in response to the sensed end position of the yarn.

An advantage of the present invention resides in that the temperature of the fluid is varied by changing a setpoint temperature of a heater. Alternatively, the temperature of the fluid is varied by mixing a cold fluid with a hot fluid.

Another advantage of the present invention resides in the fact that by maintaining a yarn take-up point substantially stationary, the tension of the yarn is maintained constant.

According to an object of the present invention, a system for maintaining a yarn take-up point stationary comprises a first sensor that is positioned proximate a first location of a travel path, the first sensor outputting a first signal, a second sensor that is positioned proximate a second location of the travel path, the second sensor outputting a second signal, and a controller that controls a temperature of a fluid employed to heat the yarn, the controller receiving the first signal and the second signal, the controller analyzing the first signal and the second signal to produce a heat control signal that controls the temperature of the fluid to subject the yarn to a tension required to maintain a yarn take-up point stationary.

According to an advantage of the present invention, the first signal and the second signal each denote one of a first operational state, such as, for example, an ON operational state, and a second operational state, such as, for example, an OFF operational state. When the first signal and the second signal denotes a first operational state, such as, for example, an ON operational state, the controller increases the temperature of the fluid. The controller reduces the temperature of the fluid when the first signal and the second signal denotes a second operational state, such as, for example, an OFF operational state. The controller maintains the temperature of the fluid constant when one signal denotes an ON operational state and the second signal denotes an OFF operational state.

According to another advantage of the present invention, the first and second sensors comprise optical sensors that determine a position of the yarn along the travel path.

According to another object of the present invention, a method is disclosed for maintaining stationary a yarn take-up point, comprising the steps of obtaining a first signal (using, for example, a first optical sensor) that is indicative of a position at a first location along a travel path, obtaining a second signal (using for example, a second optical sensor) that is indicative of the position at a second location along the travel path, and controlling a temperature of a fluid employed to heat a yarn in response to an analysis of the first signal and the second signal, in which the controlled temperature of the fluid subjects the yarn to a tension required to maintain a yarn take-up point stationary.

According to an advantage of the invention, the temperature of the fluid is increased when the first signal and the second signal each denote a first operational state; e.g., an ON state. The temperature of the fluid is reduced when the first signal and the second signal each denote a second operational state; e.g. an OFF state. Further, the temperature of the fluid is maintained constant when the first signal and the second sensor denote differing operational states.

Another advantage of the present invention resides in the controlling of the tension of the yarn in response to changed fluid temperatures.

BRIEF DESCRIPTION OF THE DRAWINGS

The foregoing and other objects, features, and advantages of the invention will be apparent from the following more particular description of preferred embodiments of the invention, as illustrated in the accompanying drawings, which are presented as a non-limiting example, in which reference characters refer to the same parts throughout the various views, and wherein.

DETAILED DESCRIPTION OF THE PREFERRED EMBODIMENTS

Figure 1:
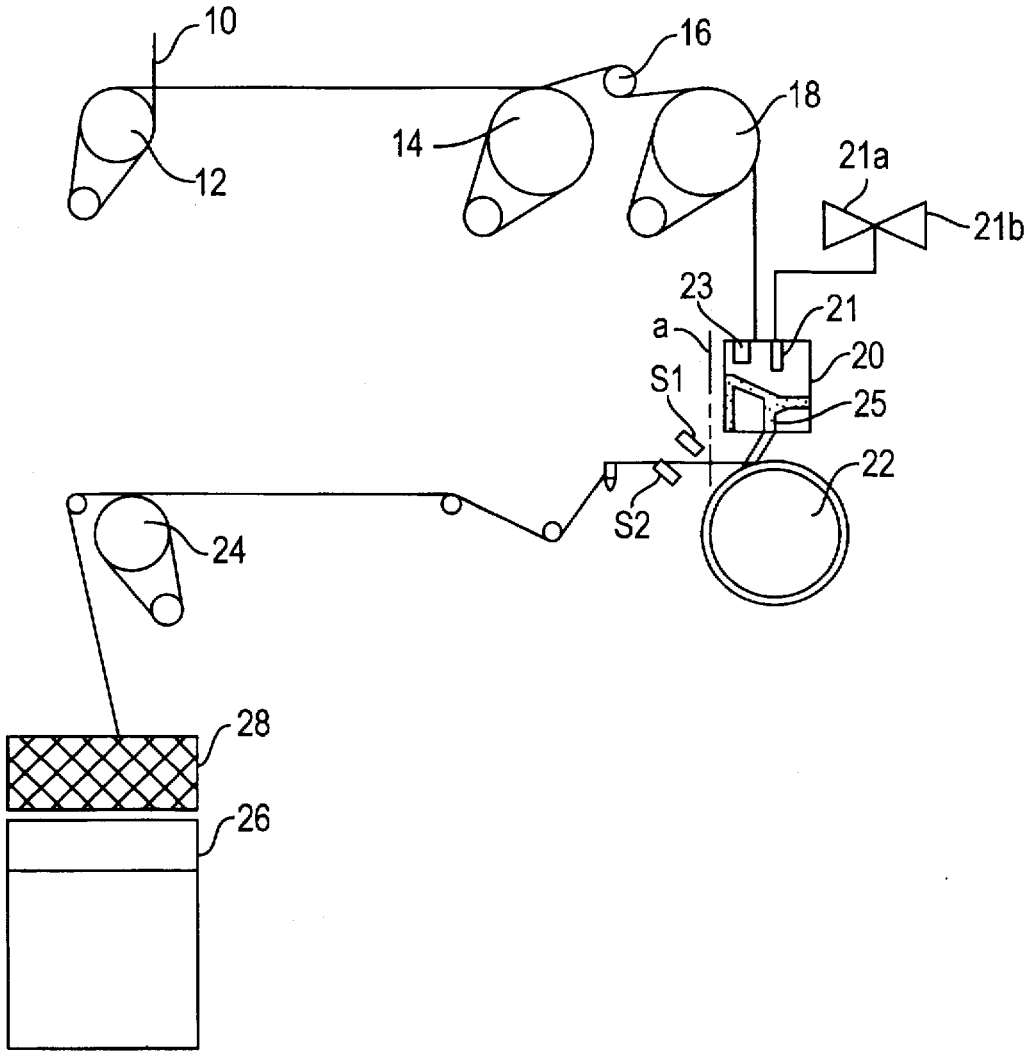
FIG. 1 illustrates a yarn texturizing system.

FIG. 1 illustrates a preferred embodiment of a yarn texturizing system. According to the preferred embodiment, a thermoplastic material 10, such as a polyolefin or polypropylene fiber, is pre-tensioned by a pretension roller 12 and supplied to a feed roll 14. The thermoplastic material 10 is pulled off the feed roll 14 and passes over a heated draw pin 16 and a draw roll 18 and supplied to a bulking jet (expansion chamber) 20. The thermoplastic material 10 is subjected to a hot fluid, such as, for example, a hot jet air stream injected into the bulking jet 20 by an injector 21, to texturize the thermoplastic material 10 into a yarn. Thereafter, the yarn is rolled onto a circular cooling drum 22 that functions to cool the yarn emitted from the bulking jet. The yarn is pulled off the cooling drum 22 by a pullout roller 24 and deposited onto a bobbin 26 with the aid of a traverse 28.

According to the present invention, a hot fluid 21*a* and a cold fluid 22*b* are combined (mixed) in desired proportions (under the control of the present invention) to obtain the desired temperature, and injected into the bulking chamber 20 via the injector 21. Alternatively, the hot fluid and cold fluid can be replaced by a heater 23, in which the desired temperature is obtained by adjusting a setpoint temperature. However, it is understood that various schemes for heating the yarn may be employed by the present invention without departing from the spirit and/or scope of the instant invention.

In order to obtain the desired texture in the yarn 10, it is important to maintain a predetermined tension on the yarn exiting from the bulking jet 20. Ideally, a yarn take-up point (plug position) 50 (see FIGS. 5 and 6) would be maintained stationary. However, the length of a yarn plug is inversely proportional to the temperature of the yarn in the bulking jet 20. Specifically, increasing the temperature of the hot fluid (e.g., heated air) applied to the yarn in the bulking jet 20 causes the yarn to shrink, increasing the denier of the yarn and thus, decreasing the yarn plug length. Conversely, a lowering of the temperature of the hot fluid applied to the yarn increases the yarn plug length. As noted above, temperature adjustments become increasingly difficult as production time (e.g., doff time) decreases.

The present invention operates to automatically control the plug position of a textured yarn by maintaining a predetermined tension on the end position of yarn as it exists the circular cooling drum 22. Specifically, the present invention controls the tension applied to the end position of the yarn 10 by monitoring deviations from a desired travel path of the end position of the yarn, such deviations controlling the temperature of a heated fluid applied to the yarn so as to increase or decrease the length of the yarn, and hence the tension.

In the preferred embodiment, two sensors S1 and S2 are positioned along the feed path of the yarn proximate an exit path of the cooling drum 22. In the preferred embodiment, sensor S1 is positioned approximately 45 degrees from a vertical (indicated by reference notation "a" in FIG. 1) in a counter-clockwise (CCW) direction from the exit of the cooling drum 22. Sensor S2 is positioned approximately 75 degrees from the vertical in the counter-clockwise direction from the exit of the cooling drum 22. Further, sensors S1 and S2 are positioned so that the sensors are not in direct contact with the yarn 10. Additionally, sensors S1 and S2 are preferably positioned approximately 2 inches from the surface of the circular cooling drum 22. However, it is understood that variations may be made in the positioning of the sensors without affecting the scope and/or spirit of the instant invention.

Figure 5:
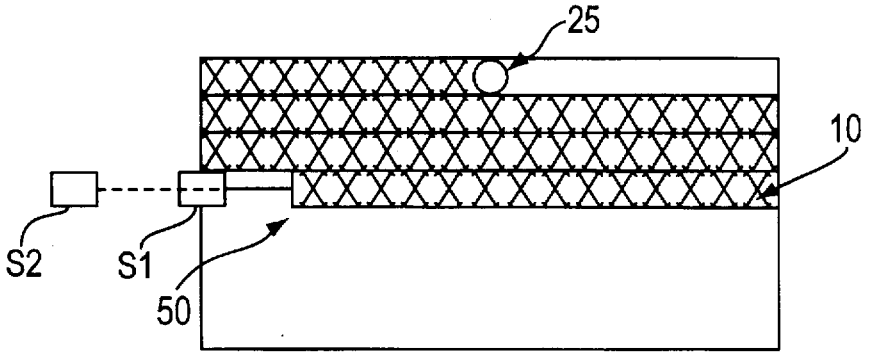
FIG. 5 illustrates a top view of a cooling drum and a positional relationship of a pair of sensors with respect to the cooling drum, associated with the yarn texturizing system of FIG. 1.
Figure 6:
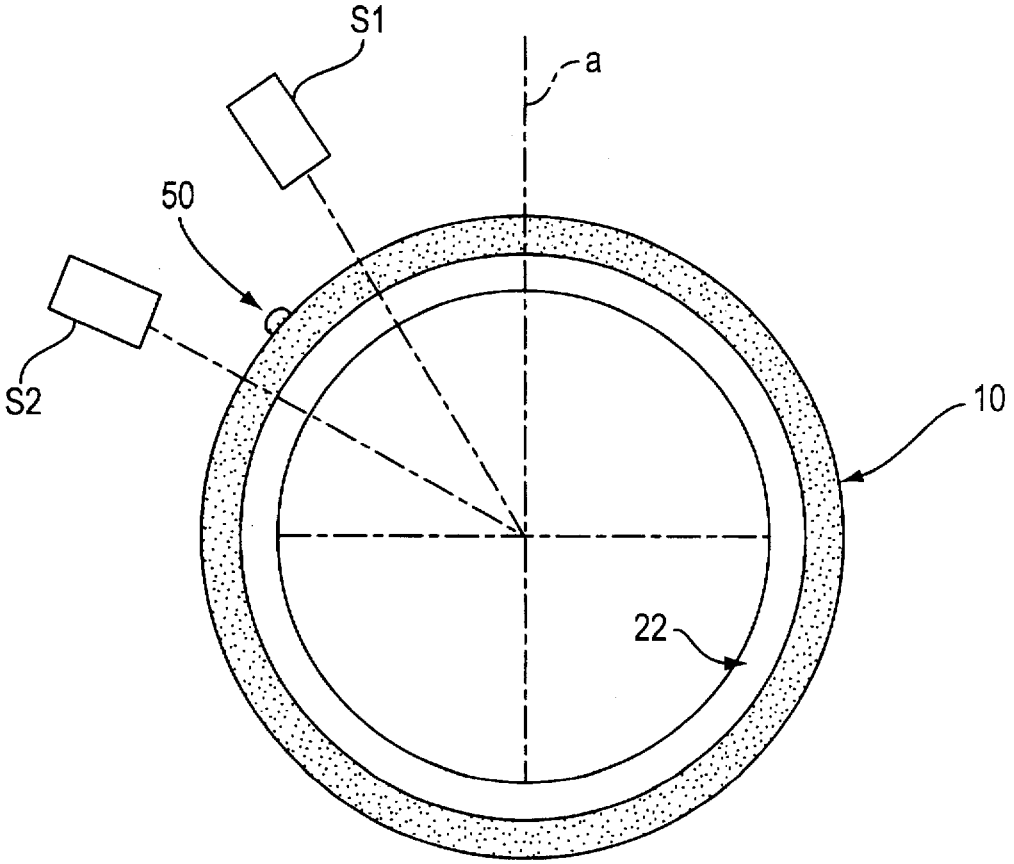
FIG. 6 illustrates an end view of the cooling drum.

FIGS. 5 and 6 illustrate a top view and an end view, respectively, showing the relationship of sensors S1 and S2 with respect to the cooling drum 22. As illustrated in FIG. 5, in the preferred embodiment, the yarn exiting an ejection point 25 of the bulking chamber 20 is wrapped around the cooling drum for a predetermined number of turns, such as, for example, three turns. The bulked yarn is coiled at this stage. Sensors S1 and S2 are positioned to be on the same plane as the last wrap of the yarn.

As shown in FIG. 6, the yarn take up point (plug position) 50 is located, in the preferred embodiment, between the positions of the sensors S1 and S2, which are positioned approximately 2 inches from the surface of the circular cooling drum 22. The yarn is pulled off the cooling drum 22, causing the uncoiling of the yarn.

In the preferred embodiment, sensors S1 and S2 comprise optical sensors having two operational states; e.g., an ON state and an OFF state. The preferred embodiment utilizes optical sensors manufactured by Sick Optic-Electronic, Inc. and having part number WT-12-P1-P1421. However, other types of sensors, such as, for example, inductance sensors, photoelectric sensors, ultrasonic sensors, laser sensors, etc. may be employed without departing from the scope and/or spirit of the present invention. Further, while the preferred embodiment discloses the use of a non-contact sensor (e.g., an optical sensor), a sensor that is in physical contact with the yarn 10 (such as, for example, a strain gauge device sensor that directly measures the tension of the yarn) may be employed without departing from the scope and/or spirit of the present invention. In addition, a sensor that produces, for example, a varying voltage, may be substituted for a sensor having two operational states without departing from the spirit and/or scope of the present invention.

As noted above, the preferred embodiment discloses the use of two sensors to define a desired travel zone within which the take-up point (e.g., end position of the yarn) is to be maintained. However, the present invention is not limited to the use of two sensors. That is, one, two, three, or more sensors may be employed without departing from the scope and/or spirit of the present invention.

In the preferred embodiment, as indicated above, the jet air temperature of the heated fluid (e.g., hot air) is varied by adjusting the jet air temperature setpoint of the heater. Alternatively, the jet air temperature may be varied by blending a cold fluid (e.g., air) stream with a hot fluid stream, based on position deviation signals provided by sensors S1 and S2. It is understood that various schemes for adjusting the temperature of the jet air and inputting it into the bulking jet 20 may be employed without departing from the spirit and/or scope of the instant invention.

The signals from sensors S1 and S2 are inputted to a control system that operates to vary the temperature of the jet air upstream of the plug in order to maintain the desired tension (and thus, travel path) of the end position of the yarn 10.

Figure 2:
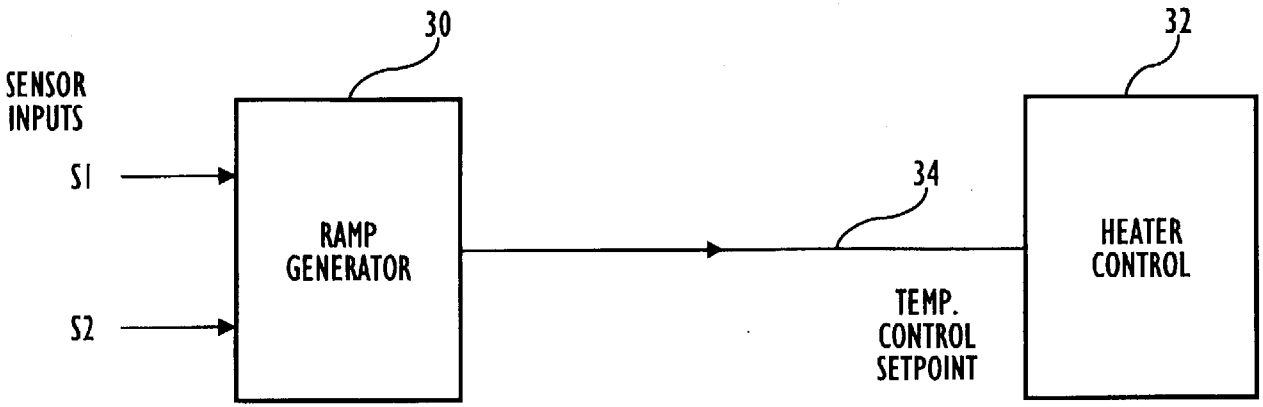
FIG. 2 illustrates a block diagram of a tension control system employed with the yarn texturizing system of FIG. 1.

FIG. 2 illustrates a control system of the preferred embodiment that is used with the texturizing system illustrated in FIG. 1. In the preferred embodiment, the control system comprises an electronic ramp function generator 30, a heater control 32, and a communications link 34 that interfaces the electronic ramp function generator 30 to the heater control 32.

In the instant invention, the electronic ramp function generator 30 receives the position deviation signals (e.g., ON/OFF operational states) from sensors S1 and S2. The electronic ramp function generator 30 converts the operational states of the sensors into a signal transmitted over the communications link 34 to control the setpoint temperature of the heater control 32. While a RS-232 communications link is employed in the preferred embodiment, other types of serial communication links, such as, for example, a RS-422 link, may be employed without departing from the spirit and/or scope of the invention. Alternatively, a parallel-type communications link may be employed. In addition, the communications link 34 may be hard-wired, as shown in FIG. 2, or may be wireless, such as, for example, an infrared communications link.

The construction of the electronic function ramp generator 30 is well known by those skilled in the art, and hence is not described herein. In the preferred embodiment, a commercially available electronic function ramp generator 30 manufactured by Analog-Digital Technology, Inc., part number ARB96-MOD is employed. The electronic ramp function generator operates to ramp up, ramp down or maintain constant a voltage inputted to the heater control 32 in order to increase, decrease or hold the setpoint temperature of the heater.

The operation of the system will be explained below with reference to the flowchart in FIG. 3.

As noted above, the preferred embodiment employs two sensors S1 and S2 that are turned ON when the yarn 10 is detected in their view. The operational state of each sensor S1 and S2 is supplied to the electronic ramp function generator 30. As a result, a signal indicative of whether the jet air temperature setpoint should be increased, decreased or maintained at its present setting is produced.

In the preferred embodiment, the logic condition of each sensor is as follows:

| S1 | S2 | Output |
|---|---|---|
| OFF | OFF | RAMP DOWN |
| OFF | ON | DON'T CARE |
| ON | OFF | HOLD CONSTANT |
| ON | ON | RAMP UP |

Figure 3:
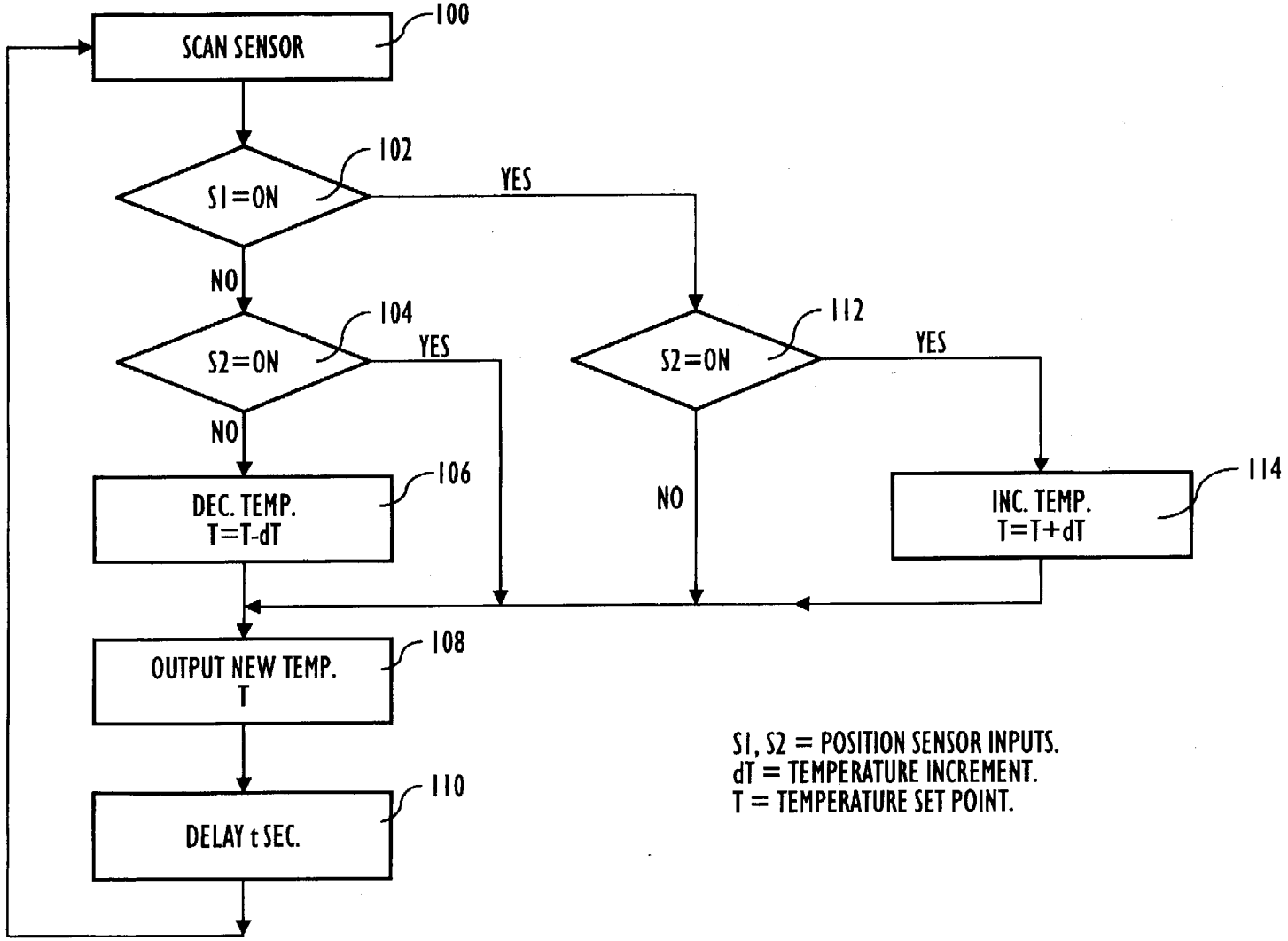
FIG. 3 illustrates a flow chart of a temperature control routine used to maintain a desired tension by the tension control system.

FIG. 3 illustrates a temperature control routine employed by the preferred embodiment to control a jet air temperature T, and hence the tension of the yarn. In step 100, sensors S1 and S2 are scanned. That is, a reading is obtained of the operational state of each sensor. Step 102 determines whether sensor S1 is ON, meaning that sensor S1 detects the yarn 10. If sensor S1 does not detect the yarn 10 (e.g., sensor S1 is determined to be OFF), step 104 is executed to determine whether sensor S2 is ON. When both sensor S1 and sensor S2 are determined to be OFF, the position of the yarn 10 is beyond the desired travel path. For example, when the operational state of sensors S1 and S2 are both OFF, the yarn 10 is positioned less than 45 degrees from the vertical in the counter-clockwise direction (relative to reference notation "a") from the exit of the cooling drum 22. Accordingly, the tension of the yarn must be adjusted to bring the yarn back to its desired travel path. This is accomplished by decreasing the jet air temperature setpoint.

Thus, step 106 is executed to ramp down the jet air temperature T by subtracting a predetermined temperature increment dT from the jet air temperature T. The new jet air temperature is output and after a delay of a predetermined time interval, the process is repeated to obtain another sensor scan (steps 108, 110 and 100).

If it is determined at step 102 that sensor S1 is ON, processing proceeds to step 112 to determine whether sensor S2 is ON. When it is determined that sensor S1 is ON, but sensor S2 is OFF, meaning the position of the yarn 10 is within the desired travel path, the jet air temperature is to be maintained in order to maintain the current tension on the yarn 10; that is, the air jet temperature is to be held constant. Accordingly, processing proceeds to step 108 to output the jet air temperature T, and after a delay of the predetermined time interval, processing returns to step 100 to perform a subsequent sensor scan.

If it is determined at step 112 that sensor S2 is ON, the end position of the yarn 10 is beyond the desired travel path. In the preferred embodiment, sensors S1 and S2 are both ON when the yarn is positioned at greater than 75 degrees from the vertical in the counter-clockwise direction (relative to reference notation "a") from the exit of the cooling drum 22. Accordingly, the jet air temperature T needs to be increased to adjust the tension on the yarn so as to bring it back to the desired travel path. Thus, step 114 is executed to raise the temperature of the fluid applied to the yarn by incrementing the air jet temperature T by the predetermined temperature increment dT. That is, the electronic ramp function generator 30 ramps up the setpoint temperature of the heat controller 32.

Figure 4:
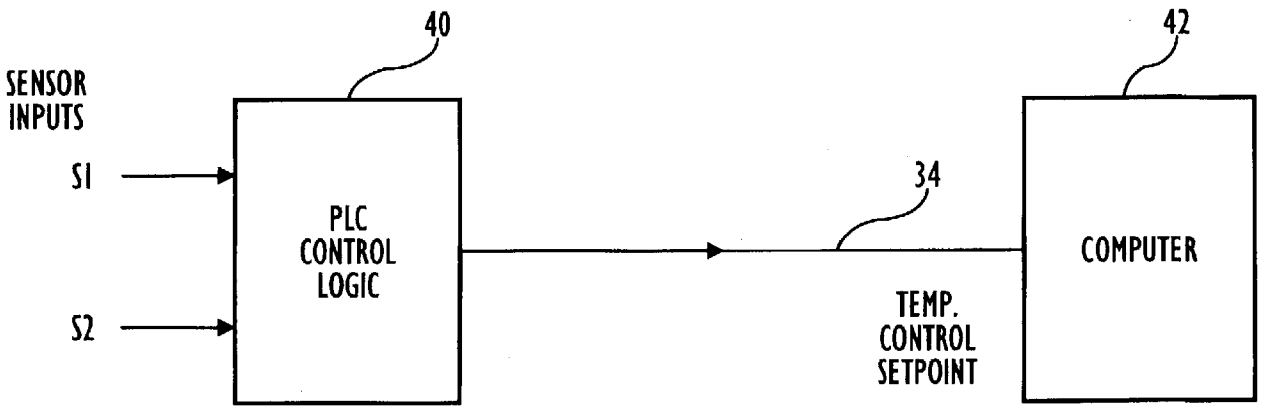
FIG. 4 illustrates an alternative tension control system.

In a second embodiment of the present invention, shown in FIG. 4, the control system comprises two optical yarn detectors (sensors), a programmable logic controller and a computer that controls the operation of an existing on-line heater. It is noted that elements similar to those disclosed earlier are denoted with the same reference element numbers in the second embodiment.

Sensors S1 and S2 function in the same manner described above with respect to the preferred embodiment. The output of each sensor is inputted to a programmable logic controller 40, which increases, decreases or maintains the setpoint temperature of an on-line heater 23 that is part of the texturizing equipment that texturizes the yarn. In the second embodiment, the programmable logic controller 40 changes the setpoint of the heater by modifying a memory of a controlling computer 42 via a RS-232 communications port 34.

The construction of the programmable logic controller 40 is well known by those skilled in the art, and thus, is not discussed herein. In the preferred embodiment, programmable logic controller 40 comprises a numerical controller that executes a specific routine (stored in a memory of the numerical controller) to control actions based upon inputted numerical data (e.g., the operational states of sensors S1 and S2). In the preferred embodiment, the programmable logic controller 40 is commercially available from Allen Bradley as part number PLC-5 series. However, it is understood that alternative controllers, such as, for example, a general purpose computer that is programmed to execute a specifically prepared program, may be employed without departing from the scope and/or spirit of the instant invention.

While the second embodiment discloses that the programmable logic controller 40 varies the temperature setpoint of the on-line heater, the jet air temperature can be adjusted by blending cold air with hot air, as described above. It is understood that such variations do not depart from the scope and/or spirit of the present invention.

The second embodiment operates in a manner similar to the preferred embodiment. Specifically, when the tension in the yarn changes, so that the travel path of the yarn deviates from a desired travel path, sensors S1 and S2 provide signals to the programmable logic array 40. Based upon the inputted operational states of sensors S1 and S2, the programmable logic controller 40 instructs the computer 42 to vary the jet air setpoint temperature of the on-line heater.

An example of the operation of the present invention will now be described.

A 500 denier polypropylene yarn 10 is processed according to the texturizing process illustrated in FIG. 1. The processing speed of the yarn into the bulking jet 20 is 1500 meters per minute (m/m). The jet air temperature T is initially set to 145 degrees Celsius. Sensor S1 is positioned approximately 45 degrees from the vertical in the counter-clockwise direction from the exit of the cooling drum 22, and approximately 2 inches from the travel path of the yarn 10. Sensor S2 is positioned approximately 75 degrees from the vertical in the counter-clockwise direction from the exit of the cooling drum 22, and approximately 2 inches from the travel path of the yarn 10. The desired tension on the yarn is obtained when the yarn 10 is positioned approximately 60 degrees from the vertical in the counter-clockwise direction from the exit of the cooling drum 22.

The output of each sensor S1 and S2 is inputted to the electronic ramp function generator 30. The ramp function is set to ±1 degree Celsius per minute, while the control temperature range is set to ±5 degrees Celsius. Table 1 summarizes the performance of the control system through the movement of the yarn end positions verses the actual jet air temperature and its setpoints, along with the operational status of each sensor S1 and S2. Data is presented in Table 1 in 5 minute intervals.

TABLE 1

| Yarn End Position (Degree CCW) | Actual Jet Air Temperature (°C.) | Jet Air Setpoint Temperature (°C.) | Status of Sensor S1 (located at 45° CCW position) | Status of Sensor S2 (located at 75° CCW position) |
|---|---|---|---|---|
| 60 | 145.5 | 145 | ON | OFF |
| 90 | 147.6 | 149.4 | ON | ON |
| 60 | 148.8 | 149.2 | ON | OFF |
| 30 | 149.2 | 146 | OFF | OFF |
| 30 | 143.2 | 140.7 | OFF | OFF |
| 60 | 141.5 | 140.7 | ON | OFF |
| 90 | 141.1 | 144.5 | ON | ON |
| 60 | 146.7 | 149.3 | ON | OFF |
| 30 | 146.2 | 140.7 | OFF | OFF |
| 60 | 141 | 140.7 | ON | OFF |
| 90 | 141.8 | 147.4 | ON | ON |
| 30 | 147.2 | 145.7 | OFF | OFF |
| 30 | 143.5 | 140.7 | OFF | OFF |
| 60 | 140.8 | 141 | ON | OFF |
| 90 | 144.6 | 149.3 | ON | ON |
| 30 | 144.7 | 140.7 | OFF | OFF |
| 60 | 141.5 | 140.7 | ON | OFF |
| 90 | 140.8 | 144.7 | ON | ON |
| 30 | 146.7 | 147.2 | OFF | OFF |
| 30 | 144.1 | 140.7 | OFF | OFF |
| 60 | 140.6 | 140.7 | ON | OFF |
| 90 | 140.7 | 143.8 | ON | ON |

As shown in Table 1, when the end position of the yarn is located at the desired 60 degree counter-clockwise position, the operational states of sensors S1 and S2 are ON and OFF, respectively, and the controlled temperature setpoint is set to 145 degrees Celsius. However, after a period of five minutes, the end position of the yarn has moved to 90 degrees counter-clockwise. Accordingly, the operational state of sensor S2 changes from OFF to ON, while the operational state of sensor S1 remains unchanged. The control system senses the change in the operational status of sensor S2, and raises the jet air temperature setpoint to 149.4 degrees Celsius. This results in the actual jet air temperature being raised from 145.5 degrees Celsius to 147.6 degrees Celsius.

In the next time period (e.g., after an elapse of a second 5 minute time period) shown in Table 1, the end position of the yarn 10 has moved back to the 60 degree counter-clockwise position as a result of the raised jet air temperature (which results in a change in the yarn tension). Thus, the operational state of sensor S2 changes from the ON state to the OFF state. The control system detects the change in the operational state of sensor S2 and interprets the current settings of the sensors as an indication that the jet air setpoint temperature should be maintained at 149.2 degrees Celsius.

As shown in Table 1, the actual jet air temperature of the yarn continues to rise to 148.8 degrees Celsius. At this high temperature, the tension of the yarn end changes, such that the yarn end moves past the 60 degree counter-clockwise position to a 30 degree counter-clockwise position, which is beyond the desired yarn travel zone. Thus, the operational states of sensors S1 and S2 become OFF and OFF, respectively. The control system senses the change in the operational state of the sensors S1 and S2, and decrease the temperature setpoint to 146 degrees Celsius.

However, after 5 minutes, the yarn position is still located at the 30 degree counter-clockwise position. Thus, the operational states of sensors S1 and S2 remain OFF and the temperature setpoint is further reduced. The second reduction of the temperature setpoint is sufficient to move the position of the yarn back to the desired 60 degree counter-clockwise travel position.

As shown by the described example, it is possible to control the tension of the yarn, and hence its travel position by detecting the travel path of the yarn. Accordingly, the present invention enable a textile manufacturer to control the tension of the yarn to obtain desired yarn properties without directly measuring the temperature of the yarn. That is, the present invention enables the jet air temperature to be controlled by monitoring the end position of the yarn as it exits the cooling drum 22. Further, the control of the yarn tension is fully automated so that human intervention is not required.

Although the invention has been described with reference to particular means, materials and embodiments, it is to be understood that the invention is not limited to the particulars disclosed and extends to all equivalents within the scope of the claims.

What is claimed is:

1. An automatic control system for controlling tension on a yarn, comprising:

means for sensing a travel path of said yarn at two predetermined positions after said yarn has been subjected to a heated fluid; and means for varying a temperature of said heated fluid, in response to said sensed travel path of said yarn at said two predetermined positions, to vary said tension of said yarn to maintain a yarn take-up point proximate a target position between said two predetermined positions.

2. The automatic control system of claim 1, wherein said sensing means comprises two sensors, a first sensor being positioned at a first predetermined position of said two predetermined positions along a path of said yarn, a second sensor being positioned at a second predetermined position of said two predetermined positions along said path of said yarn.

3. The automatic control system of claim 1, wherein said varying means comprises means for blending a cold air stream with a hot air stream.

4. The automatic control system of claim 1, wherein said varying means varies a setpoint temperature to maintain a constant tension on said yarn.

5. The automatic control system of claim 2, wherein said two sensors comprise two optical sensors.

6. The automatic control system of claim 1, wherein said tension of said yarn is varied to maintain said yarn take-up point substantially stationary.

7. A method for controlling a tension on a yarn, comprising:

sensing a travel path of the yarn at two predetermined positions after the yarn has been subjected to a heated fluid; and varying a temperature of the heated fluid, in response to the sensed travel path of the yarn at the two predetermined positions, to vary the tension of the yarn to maintain a yarn take-up point proximate a target position between said two predetermined positions.

8. The method of claim 7, wherein the sensing step comprises the step of detecting an ejection travel path of the yarn.

9. The method of claim 7, wherein sensing a travel path of the yarn comprises using an inductance sensor.

10. The method of claim 7, wherein the sensing step comprises using an optical sensor.

11. The method of claim 7, wherein the sensing step comprises detecting the travel path of the yarn at two predetermined positions using two sensors, in which a first sensor is positioned at a first predetermined position of the two predetermined positions along a path of the yarn and a second sensor is positioned at a second predetermined position of the two predetermined positions along the path of the yarn.

12. The method of claim 7, wherein the varying step comprises the step of varying a setpoint temperature of the heated fluid so that a constant tension is maintained on the yarn.

13. The method of claim 7, wherein the sensing step comprises using a strain gauge sensor that measures a yarn tension.

14. The method of claim 11, wherein the sensing step comprises detecting the travel path of the yarn using two optical sensors.

15. The method of claim 9, wherein the varying step comprises the step of varying a setpoint temperature of the heated fluid so that a constant tension is maintained on the yarn.

16. A method for controlling a tension on a yarn, comprising:

sensing a travel path of the yarn after the yarn has been subjected to a heated fluid; and varying a temperature of the heated fluid by blending a cold air stream with a hot air stream in order to vary the tension of the yarn.

17. The method of claim 16, wherein the blending step varies the temperature to maintain a constant tension on the yarn.

18. A system for controlling a tension on a yarn, comprising:

a first sensor positioned proximate a first predetermined location of a travel path of the yarn to sense a position of the yarn;

a second sensor positioned proximate a second predetermined location of a travel path of the yarn to sense a position of the yarn; and a controller that operates to vary a temperature of a fluid to which the yarn is subjected to effect a change in a tension of the yarn in response to said sensed position of the yarn by said first sensor and said second sensor, so that a yarn take-up point is positioned proximate a target location between said first predetermined position and said second predetermined location.

19. The system of claim 18, wherein said temperature of said fluid is varied by changing a setpoint temperature of a heater.

20. The system of claim 18, wherein said change in tension of the yarn functions to maintain said yarn take-up point substantially stationary.

21. A system for controlling a tension on a yarn, comprising:

a sensor positioned proximate a predetermined location of a travel path of the yarn to sense a position of the yarn; and a controller that operates to vary a temperature of a fluid to which the yarn is subjected to effect a change in a tension of the yarn in response to said sensed position of the yarn, wherein said temperature of said fluid is varied by mixing a cold fluid with a hot fluid.

22. A system for maintaining substantially stationary a yarn take-up point, comprising:

a first sensor positioned proximate a first location of a yarn travel path, said first sensor outputting a first signal;

a second sensor positioned proximate a second location of said yarn travel path, said second sensor outputting a second signal; and a controller that controls a temperature of a fluid employed to heat a yarn, said controller receiving said first signal and said second signal, said controller analyzing said first signal and said second signal to produce a heat control signal that controls said temperature of the fluid to subject the yarn to a tension required to maintain the yarn take-up point substantially stationary, wherein each of said first signal and said second signal denote one of an ON operational state and an OFF operational state.

23. The system of claim 22, wherein said controller reduces said temperature of the fluid when said first signal denotes an OFF operational state of said first sensor and said second signal denotes an OFF operational state of said second sensor.

24. The system of claim 22, wherein said controller increases said temperature of the fluid when said first signal denotes an ON operational state of said first sensor and said second signal denotes an ON operational state of said second sensor.

25. The system of claim 22, wherein said controller maintains said temperature of the fluid constant when said first signal denotes an ON operational state of said first sensor and said second signal denotes an OFF operational state of said second sensor.

26. The system of claim 22, wherein said first sensor and said second sensor comprise optical sensors that determine a position of said yarn along said yarn travel path.

27. The system of claim 22, wherein said controller (a) increases said temperature of the fluid when said first signal and said second signal each denote a first operational state of said first sensor and said second sensor, (b) reduces said temperature of the fluid when said first signal and said second signal each denote a second operational state of said first sensor and said second sensor, and (c) maintains said temperature of the fluid constant when said first signal and said second sensor denotes differing operational states of said first sensor and said second sensor.

28. The system of claim 27, wherein said first operation state comprises an ON state and said second operational state comprises an OFF state.

29. The system of claim 22, wherein said first sensor and said second sensor comprise strain gauge sensors that determine a tension of said yarn along said yarn travel path.

30. A method for maintaining substantially stationary a yarn take-up point, comprising:

obtaining a first signal indicative of a yarn position at a first location along a yarn travel path;

obtaining a second signal indicative of the yarn position at a second location along the yarn travel path; and controlling a temperature of a fluid employed to heat a yarn in response to an analysis of the first signal and the second signal, the controlled temperature of the fluid subjecting the yarn to a tension required to maintain the yarn take-up point substantially stationary by:

increasing the temperature of the fluid when the first signal and the second signal each denote a first operational state;

reducing the temperature of the fluid when the first signal and the second signal each denote a second operational state; and maintaining the temperature of the fluid constant when the first signal and the second sensor denote differing operational states.

31. The method of claim 30, wherein the controlling step controls the tension of the yarn in response to changed fluid temperatures.

32. The method of claim 30, wherein the step of obtaining the first signal comprises using a first optical sensor, and the step of obtaining the second signal comprises using a second optical sensor.

33. The method of claim 30, wherein the controlling step comprises controlling the temperature of the fluid employed to heat a polyolefin fiber.

34. The method of claim 30, wherein the controlling step comprises controlling the temperature of the fluid employed to heat a polypropylene fiber.

35. A method for maintaining substantially stationary a take-up point in a process for producing polyolefin fibers, comprising the steps of:

obtaining a first signal indicative of a predetermined parameter of a polyolefin fiber at a first location along a travel path;

obtaining a second signal indicative of the predetermined parameter at a second location along the travel path; and controlling a temperature of a fluid employed to heat the polyolefin fiber in response to an analysis of the first signal and the second signal, the controlled temperature of the fluid subjecting the polyolefin fiber to a tension required to maintain the take-up point substantially stationary.

36. The method of claim 35, wherein the polyolefin fiber comprises a polypropylene fiber.

37. An automatic control system for controlling a tension on a yarn, comprising:

means for sensing a travel path of said yarn after said yarn has been subjected to a heated fluid; and means for blending a cold air stream with a hot air stream to vary a temperature of said heated fluid in order to vary said tension of said yarn.

38. The automatic control system of claim 37, wherein said sensing means comprises at least one sensor.

39. The automatic control system of claim 38, wherein said at least one sensor comprises at least one optical sensor.

40. The automatic control system of claim 38, wherein said at least one sensor comprises at least one inductance sensor.

41. The automatic control system of claim 37, wherein said blending means varies a setpoint temperature to maintain a constant tension on said yarn.

42. A method for controlling a production of a yarn, comprising:

sensing a travel path of the yarn at two predetermined positions after the yarn has been subjected to a heated fluid; and varying a temperature of the heated fluid in response to the sensed travel path of the yarn at the two predetermined positions, to control desired properties of the yarn so that a yarn take-up point is positioned proximate a target position between said two predetermined positions.

43. A method for maintaining a yarn take-up point substantially stationary, comprising:

obtaining a first signal from a first sensor that is indicative of a yarn position at a first predetermined location along a yarn travel path;

obtaining a second signal from a second sensor that is indicative of the yarn position at a second predetermined location along the yarn travel path; and controlling a fluid temperature applied to a yarn in response to an analysis of the first signal and the second signal to subject the yarn to a tension required to maintain the yarn take-up point substantially stationary between said first predetermined location and said second predetermined location.

* * * * *